United States Patent [19]

Lundy

[11] Patent Number: 4,674,489

[45] Date of Patent: Jun. 23, 1987

[54] TUBULAR SUPPORT BANDAGES

[75] Inventor: Roy Lundy, Oldham, England

[73] Assignee: Seton Products Limited, Lancashire, England

[21] Appl. No.: 797,963

[22] Filed: Nov. 14, 1985

[30] Foreign Application Priority Data

Nov. 15, 1984 [GB] United Kingdom ..... 8428893

[51] Int. Cl.[4] ..... A61L 5/40

[52] U.S. Cl. ..... 128/160; 128/156; 128/157

[58] Field of Search ..... 128/156, 157, 160

[56] References Cited

U.S. PATENT DOCUMENTS

| | | | |
|---|---|---|---|
| 3,306,288 | 2/1967 | Rosenfield | 128/157 |
| 3,307,546 | 3/1967 | Cherio et al. | 128/157 |
| 3,881,473 | 5/1975 | Corvi | 128/156 |
| 3,882,857 | 5/1975 | Woodall, Jr. | 128/156 |
| 4,207,885 | 6/1980 | Hampton | 128/156 |
| 4,236,550 | 12/1980 | Braun | 128/156 |

FOREIGN PATENT DOCUMENTS 840523 7/1960 United Kingdom .

*Primary Examiner*—Gregory E. McNeill

*Attorney, Agent, or Firm*—Fisher, Christen & Sabol

[57] ABSTRACT

A tubular support bandage is made from a knitted fabric tube with a laid-in helical elastic yarn. The knit structure is arranged, for example, by providing courses of missing loops, so that different regions have different knit densities and the elastic yarns can move more closely together in the lower density regions.

8 Claims, 18 Drawing Figures

| | | | | | | | | | | | | | | | | | | | | |
|---|---|---|---|---|---|---|---|---|---|---|---|---|---|---|---|---|---|---|---|---|
| 8 | C | | C | | B | | C | | B | | C | | B | | C | | B | | C | | B |
| | D | C | | C | | C | | C | | C | | C | | C | | C | | C | | C | |
| 7 | C | | C | | B | | C | | B | | C | | B | | C | | B | | C | | B |
| | D | C | | C | | C | | C | | C | | C | | C | | C | | C | | C | |
| 6 | C | | A | | B | | A | | B | | A | | B | | A | | B | | A | | B |
| | D | D | | D | | D | | D | | D | | D | | D | | D | | D | | D | |
| 5 | C | | A | | B | | A | | B | | A | | B | | A | | B | | A | | B |
| | D | D | | D | | D | | D | | D | | D | | D | | D | | D | | D | |
| 4 | C | | A | | C | | A | | C | | A | | C | | A | | C | | A | | C |
| | D | C | | C | | C | | C | | C | | C | | C | | C | | C | | C | |
| 3 | C | | A | | C | | A | | C | | A | | C | | A | | C | | A | | C |
| | D | C | | C | | C | | C | | C | | C | | C | | C | | C | | C | |
| 2 | C | | A | | B | | A | | B | | A | | B | | A | | B | | A | | B |
| | D | D | | D | | D | | D | | D | | D | | D | | D | | D | | D | |
| 1 | C | | A | | B | | A | | B | | A | | B | | A | | B | | A | | B |
| | D | D | | D | | D | | D | | D | | D | | D | | D | | D | | D | |

I

FIG. 3

| | | | | | | | | | | | | | | | | | | | | |
|---|---|---|---|---|---|---|---|---|---|---|---|---|---|---|---|---|---|---|---|---|
| 8 | C | | C | | B | | C | | B | | C | | B | | C | | B | | C | | B |
| | D | C | | C | | C | | C | | C | | C | | C | | C | | C | | C | |
| 7 | C | | C | | B | | C | | B | | C | | B | | C | | B | | C | | B |
| | D | D | | D | | D | | D | | D | | D | | D | | D | | D | | D | |
| 6 | C | | A | | B | | A | | B | | A | | B | | A | | B | | A | | B |
| | D | D | | D | | D | | D | | D | | D | | D | | D | | D | | D | |
| 5 | C | | A | | B | | A | | B | | A | | B | | A | | B | | A | | B |
| | D | D | | D | | D | | D | | D | | D | | D | | D | | D | | D | |
| 4 | C | | A | | C | | A | | C | | A | | C | | A | | C | | A | | C |
| | D | C | | C | | C | | C | | C | | C | | C | | C | | C | | C | |
| 3 | C | | A | | C | | A | | C | | A | | C | | A | | C | | A | | C |
| | D | D | | D | | D | | D | | D | | D | | D | | D | | D | | D | |
| 2 | C | | A | | B | | A | | B | | A | | B | | A | | B | | A | | B |
| | D | D | | D | | D | | D | | D | | D | | D | | D | | D | | D | |
| 1 | C | | A | | B | | A | | B | | A | | B | | A | | B | | A | | B |
| | D | D | | D | | D | | D | | D | | D | | D | | D | | D | | D | |

I

FIG. 4

| | | | | | | | | | | | | | | | | | | | | | | |
|---|---|---|---|---|---|---|---|---|---|---|---|---|---|---|---|---|---|---|---|---|---|---|
| 8 | C | | C | | B | | C | | B | | C | | B | | C | | B | | C | | B | |
| | D | D | | D | | D | | D | | D | | D | | D | | D | | D | | D | | |
| 7 | C | | C | | B | | C | | B | | C | | B | | C | | B | | C | | B | |
| | D | D | | D | | D | | D | | D | | D | | D | | D | | D | | D | | |
| 6 | C | | A | | B | | A | | B | | A | | B | | A | | B | | A | | B | I |
| | D | D | | D | | D | | D | | D | | D | | D | | D | | D | | D | | |
| 5 | C | | A | | B | | A | | B | | A | | B | | A | | B | | A | | B | |
| | D | D | | D | | D | | D | | D | | D | | D | | D | | D | | D | | |
| 4 | C | | A | | C | | A | | C | | A | | C | | A | | C | | A | | C | |
| | D | D | | D | | D | | D | | D | | D | | D | | D | | D | | D | | |
| 3 | C | | A | | C | | A | | C | | A | | C | | A | | C | | A | | C | |
| | D | D | | D | | D | | D | | D | | D | | D | | D | | D | | D | | |
| 2 | C | | A | | B | | A | | B | | A | | B | | A | | B | | A | | B | I |
| | D | D | | D | | D | | D | | D | | D | | D | | D | | D | | D | | |
| 1 | C | | A | | B | | A | | B | | A | | B | | A | | B | | A | | B | |
| | D | D | | D | | D | | D | | D | | D | | D | | D | | D | | D | | |

FIG. 5

TUBULAR SUPPORT BANDAGES

This invention relates to tubular support bandages, that is, to elasticated tubular bandages of the kind which in use is fitted around a part of a patient's body to apply pressure thereto.

A well-known kind of tubular support bandage, as described in U.K. Pat. No. 840,523, is formed from a knitted fabric tube which is of uniform structure and dimensions throughout its length and which incorporates a number of evenly-pitched helically disposed continuous elastic rubber yarns. With this bandage in the case where different pressures are required at different positions, e.g. where greater pressure is required in the lower region than in the upper region of a patient's leg, it is usual to fold over an appropriate portion of the bandage. However, this can be inconvenient from the point of view of the person fitting the bandage, and also may be of limited applicability in terms of the degree and location of pressure in that, for example, it may not be feasible to fold the bandage so as to apply increased pressure in a central region or in two or more spaced regions.

Tubular support bandages are also known which are of tapered construction, this being achieved by applying tension to laid-in rubber yarns as they are fed to the knitting machine during knitting of an end portion of the bandage. With this arrangement greater pressure can be applied in the vicinity of the constricted end portion of the bandage without requiring this to be folded over. However, limitations are imposed on the extent to which pressure can be increased having regard to the elastic limit of the rubber yarns. That is, with the folded-over arrangement increased pressure is achieved by increase in the density of rubber yarns in the selected region whereas, with the tapered arrangement increased pressure is achieved solely by reliance on greater stretching of the rubber yarns.

In theory, a tubular structure having one or more regions with a greater density of elastic rubber yarns could be achieved by laying in one or more additional yarns during knitting of one or more selected portions of the bandage but in practice this would not be acceptable because the additional rubber yarns being unsecured at their ends would tend readily to work loose.

An object of the present invention is to provide a tubular structure which has one or more regions with a greater elastic yarn density yet which is convenient to use and of secure construction.

According to the invention therefore there is provided a tubular support bandage comprising a knitted fabric tube incorporating one or more helically disposed continuous elastic yarns characterised in that the knit structure is of a non-uniform nature along the length of the tube to the extent that at least one part has a lower density of knitted fabric yarns compared with at least one other part of the tube.

With this arrangement it will be appreciated that the elastic yarn (or yarns) will tend to compress the knitted tube in the relatively low density part (or parts) so that the elastic yarn turns are moved more closely together than in the higher density part (or parts) of the tube. In this way a greater elastic yarn density can be achieved in a selected region (or regions) with a tubular structure which can be conveniently fitted and is of secure construction.

With regard to the lower density knit structure this may be achieved in any suitable manner. Preferably however missed loops are relied on to produce the requisite density reduction.

Particularly where the bandage is to be used to apply pressure to a patient's leg, the bandage may have a single said lower density region at that end portion which in use is applied to the lower part of the patient's leg. Other arrangements are however also possible. Thus the bandage may have a lower density region other than at the lower end portion (e.g. in the centre of the bandage) and/or there may be two or more lower density regions.

The (or each) lower density region may be of uniform structure throughout (or may have a regularly repeated pattern throughout). Alternatively the (or each) lower density region may vary in density e.g. may be of progressively decreasing density in one direction along the length of the tubular structure. Similarly the (or each higher density region may be of uniform or varying structure throughout.

The knit structure may be of any suitable type, and any suitable kind and number of elastic yarns may be incorporated in any suitable manner. In a preferred embodiment the bandage is a seamless structure knitted in continuous length using a circular knitting machine so as to have a degree of circumferential and longitudinal stretch, and a plurality of elastic yarns (e.g. four elastic yarns) may be laid in between front and rear loops in periodic courses (e.g. every four courses) so as to define a multi-start helix which would be of even pitch except for the effect of the low density part or parts. Thus, the structure may be as described in U.K. Pat. No. 840,523 except for the low density part or parts.

The tubular bandage may be of parallel structure and the elastic yarn or yarns may be arranged so as to be inert or limp in the normal out-of-use state of the bandage and to become tensioned as the bandage is expanded in use. Alternatively, the elastic yarn may be pre-tensioned so as to influence the shaping of the bandage e.g. so as to constrict or taper part of the tubular structure.

Preferably the fabric structure is formed from cotton and the elastic yarn or yarns are formed from cotton-covered rubber threads. However any other suitable natural and/or synthetic materials may be used.

The invention will now be described further by way of example only and with reference to the accompanying drawing in which:

FIGS. 3–5 show different knit patterns which can be used in bandages according to the invention.

Figure 1:
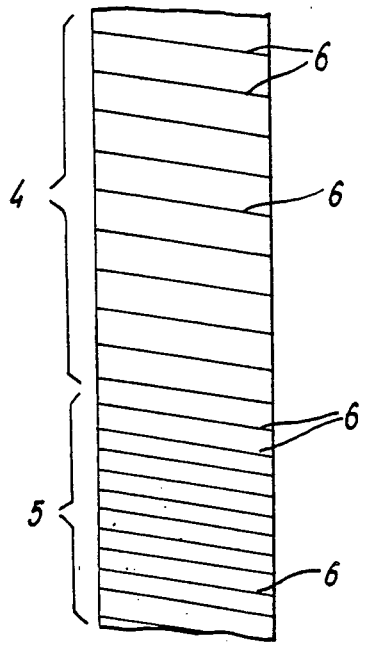
FIG. 1 is a diagrammatic representation of one form of a tubular bandage according to the invention.

The bandage shown in the drawing is intended for use as a leg bandage and is knitted on a circular knitting machine as a continuous, seamless, parallel-sided tubular structure which when laid flat is 2½" (6.35 cm) wide and has 16 courses to the inch with 120 stitches in each course. Sixteen cotton ends and four cotton-covered elastic rubber ends are fed to the machine whereby the rubber yarns are laid in between front and back knitted loops every four courses defining a multi-start rubber helix extending continuously throughout the length of the bandage. The rubber yarns comprise an 886 denier white rubber filament.

The cotton yarns are knitted one by one with a constant loop size throughout with certain exceptions as explained hereinafter.

The bandage is pre-cut to a length suited to the intended use thereof and if desired and as necessary the cut ends may be appropriately finished.

Figure 2:
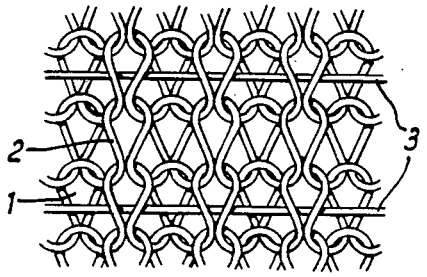
FIG. 2 is a detail to a larger scale showing part of the knit structure of the bandage.

FIG. 2 shows the abovementioned one-by-one knitted structure of the bandage with plain loops 1, ribbed loops 2 and laid-in rubber yarns 3. Along a major portion 4 of the length of the bandage from one end thereof the knit structure conforms exactly to that shown in FIG. 2. Along a minor portion 5 of the length from the opposite end of the bandage the knit structure comprises a modified version of that shown in FIG. 1. That is, in such portion 5 there is the same number of courses between rubber yarn turns 6 but in at least some courses there are missing knitted loops. The effect of this is to reduce the density of the knitted structure so that the rubber yarn turns 6 can move closely together than is the case in the other portion 4 of the bandage.

The exact pattern of the modified knit structure particularly in terms of the number of courses between rubber yarn turns 6 having missed loops and the numbers of missed loops in such courses will be selected in accordance with requirements. For example, the arrangement may be such that the rubber yarns move freely together as closely as if they were laid in every three courses or every two courses of the regular knit structure shown in FIG. 2. Moreover it will be understood that the knit structure may be the same or different between different pairs of adjacent rubber yarn turns 6 in the portion 5 as desired.

With the arrangement so far described, the bandage can be applied to a patient's leg so that the major portion 4 fits around the upper part of the leg and the minor portion 5 fits around the lower part. Greater pressure will then be applied to the lower part due to the closer spacing of the rubber yarn turns 6 in this region. Since it is not necessary to fold over the bandage, fitting onto the patient's leg can be effected in a convenient manner. The rubber yarns extend throughout the length of the bandage as is the case with conventional structures whereby a secure and hard-wearing construction is ensured.

The bandage so far described may be manufactured on a circular knitting machine having 180×180 needles (dial and cylinder) with appropriate pattern control to effect modification of the knit structure as discussed above at the appropriate positions along the length of the formed tubular bandage. Pattern control by cam operation of dial needles can raise problems in the case of a relatively small diameter circular knitting machine due to the lack of space in the vicinity of the dial needles. Accordingly, pattern control can be effected with a modified machine by cam adjustment of the cylinder needles and by remote linkages extending between the dial and the control box.

It is of course to be understood that the invention is not intended to be restricted to the details of the above embodiment which are described by way of example only. In particular, the dimensions and structure of the knitted bandage may be selected as desired. A much larger diameter will be appropriate where the bandage is to be applied to a patient's trunk and a much smaller diameter where it is to be applied to a finger. The knit structure need not be of the plain ribbed nature shown in FIG. 2 but may be of any other suitable kind. Any suitable number and frequency of rubber yarns may be laid in or otherwise incorporated in the tubular structure.

Also, the lower density modified knit structure is not restricted to a single end portion of the bandage but may be provided at a different portion and/or in multiple bands. Thus, although it is visualised that the invention will find particular application in the context of leg bandages intended to apply an increased pressure to the calf region it will be understood that the invention may also be utilised in the context of leg bandages intended to apply increased pressure selectively to knee and/or thigh regions as also to bandages for applying differential pressures to other parts of a patient's body.

FIGS. 3 to 5 show, by way of further example, suitable knit patterns for tubular bandages in accordance with the invention. In these figures, the numbers at the left hand side identify the different yarn feeds in the context of a circular knitting machine as described above with reference to FIGS. 1 and 2. Only eight yarn feeds are shown since the pattern is repeated for yarn feeds 9 to 16. The letters C and D at the left represent respectively cylinder and dial needles, and the letters A, B, C, D of the knit pattern represent respectively: knitting with an A needle of the cylinder, knitting with a B needle of the cylinder, a miss, knitting with the dial. The laid-in elastic yarns are identified by reference letter "I". With the knit pattern of FIG. 3 there are two courses of knitted loops between each elastic yarn turn, the loops of the other two courses being missed. With FIG. 4 there are three courses of knitted loops and one of missed loops between elastic yarn turns. FIG. 5 shows the knit pattern relating to those regions of the tubular bandage in which there are four courses of knitted loops and no courses of missed loops between the elastic yarn turns. Thus, FIG. 5 represents the highest density attainable with the particular knit arrangement, and FIGS. 3 and 4 represent lower density structures.

Figure 6A:
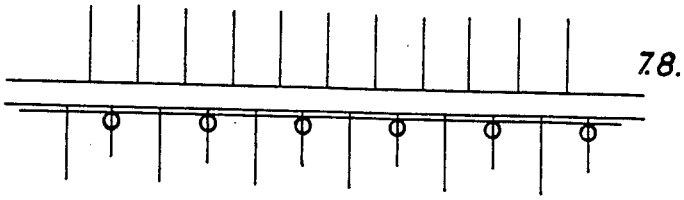
FIGS. 6–8 show needle positions corresponding to the pattern of FIGS. 3 to 5.
Figure 6B:
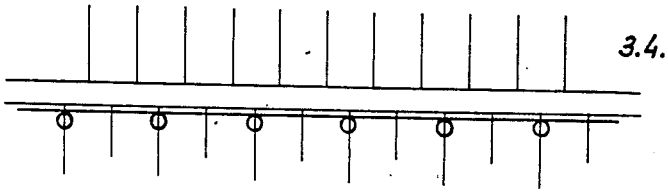
Figure 6C:
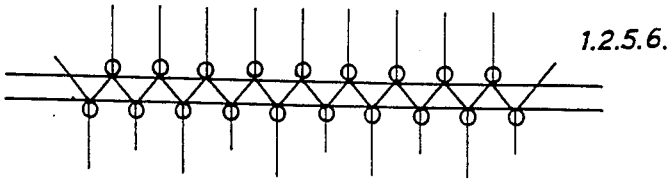
Figure 7A:
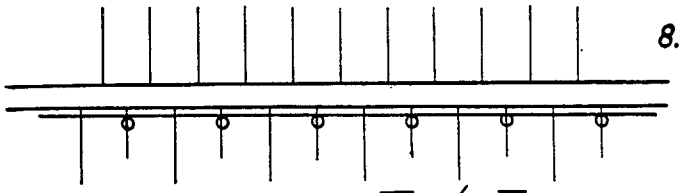
Figure 7B:
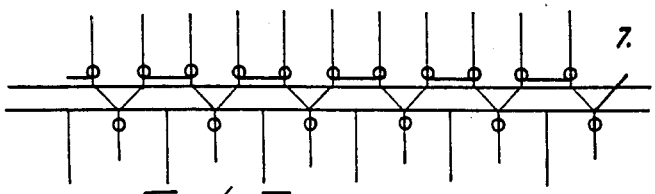
Figure 7C:
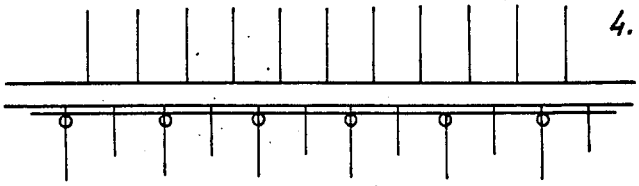
Figure 7D:
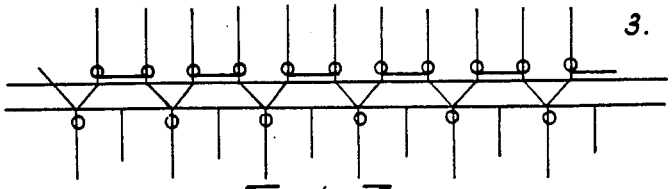
Figure 7E:
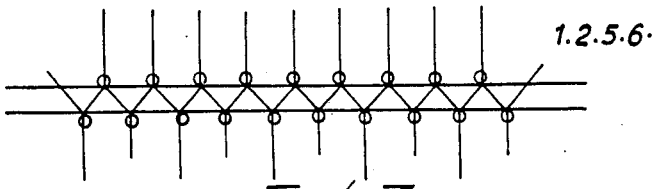
Figure 8A:
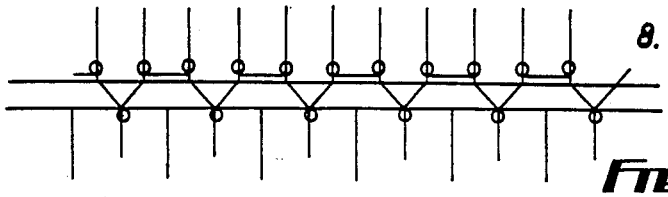
Figure 8B:
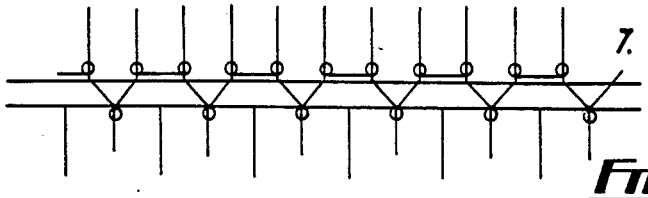
Figure 8C:
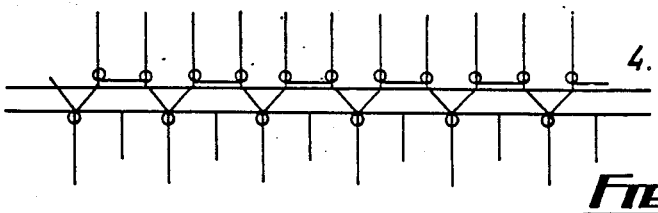
Figure 8D:
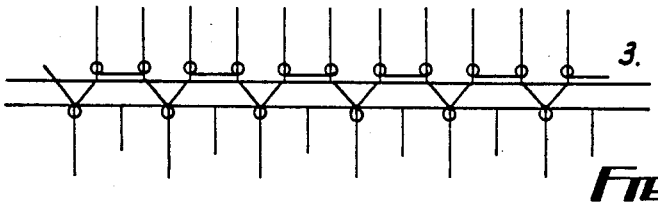
Figure 8E:
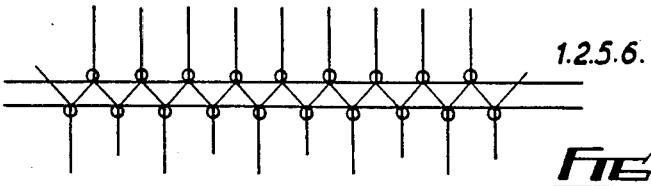

FIGS. 6 to 8 show the needle arrangements for the knit patterns of FIGS. 3 to 5.

In each drawing the dial needles are at the top and the cylinder needles at the bottom (or the arrangement) may be vice versa). The numbers at the right hand sides identify the courses to which the needle arrangements relate (corresponding to the eight identifying course numbers in FIGS. 3 to 5).

I claim:

1. A pressure-applying tubular support bandage for application to a part of a patient's body comprising a knitted fabric tube incorporating one or more helically disposed continuous elastic yarns characterised in that the knit structure is of a non-uniform nature along the length of the tube so that at least one longitudinal part of the tube has a lower density of knitted fabric yarns compared with at least one other longitudinal part thereof, whereby different pressures can be applied respectively to different portions of said part of the patient's body.

2. A support bandage according to claim 1, characterised in that the lower density is achieved by means of a knit pattern having courses of missed loops.

3. A support bandage according to claim 1, characterised in that there is a single said longitudinal part of lower density and said part is at one end portion of the bandage.

4. A support bandage according to claim 1, characterised in that the or each part of lower density is of uniform structure, or has a regularly repeated pattern, throughout.

5. A support bandage according to claim 1, characterised in that the or each said part of lower density is of progressively decreasing density in one direction along the length of the tube.

6. A support bandage according to claim 1, characterised in that the tube is a seamless circular knit structure having the or each said elastic yarn laid in between front and rear loops in periodic courses.

7. A support bandage according to claim 6, characterised in that there is a plurality of elastic yarns laid in every four courses.

8. A support bandage according to claim 7, chracterised in that the knit structure is formed from 16 fabric yarn ends and four elastic yarns which are laid in to define a multi-start elastic helix.

* * * * *